United States Patent [19]

Oguri et al.

[11] Patent Number: 4,930,476

[45] Date of Patent: Jun. 5, 1990

[54] GOVERNOR FOR VERTICAL V-TYPE ENGINE

[75] Inventors: Kiyohiko Oguri; Tsuyoshi Ohkawa, both of Iwata, Japan

[73] Assignee: Yamaha Hatsudoki Kabushiki, Iwata, Japan

[21] Appl. No.: 382,091

[22] Filed: Jul. 19, 1989

[51] Int. Cl.[5] ..... F02D 31/00

[52] U.S. Cl. ..... 123/376; 123/195 HC; 123/55 VF

[58] Field of Search ..... 123/55 VE, 55 VF, 55 VS, 123/376, 400, 195 HC, 196 W, 41.7, 352

[56] References Cited

U.S. PATENT DOCUMENTS

| | | | |
|---|---|---|---|
| 1,880,456 | 10/1932 | Moorhouse | 123/376 |
| 2,716,397 | 8/1955 | Heinish | 123/376 |
| 2,781,750 | 2/1957 | Chayne | 123/55 VE |
| 3,492,977 | 2/1970 | Fager | 123/55 VE |
| 3,997,019 | 12/1976 | Inoue | 123/376 |
| 4,136,648 | 1/1979 | Ernest | 123/55 VE |

*Primary Examiner*—Tony M. Argenbright
*Assistant Examiner*—Robert E. Mates
*Attorney, Agent, or Firm*—Ernest A. Beutler

[57] ABSTRACT

An improved governor mechanism for an engine having angularly related staggered cylinder banks. The governor mechanism includes a link or motion transmitting member that is disposed within the stagger between the cylinder banks so as to provide a compact assembly.

4 Claims, 4 Drawing Sheets

Figure 4
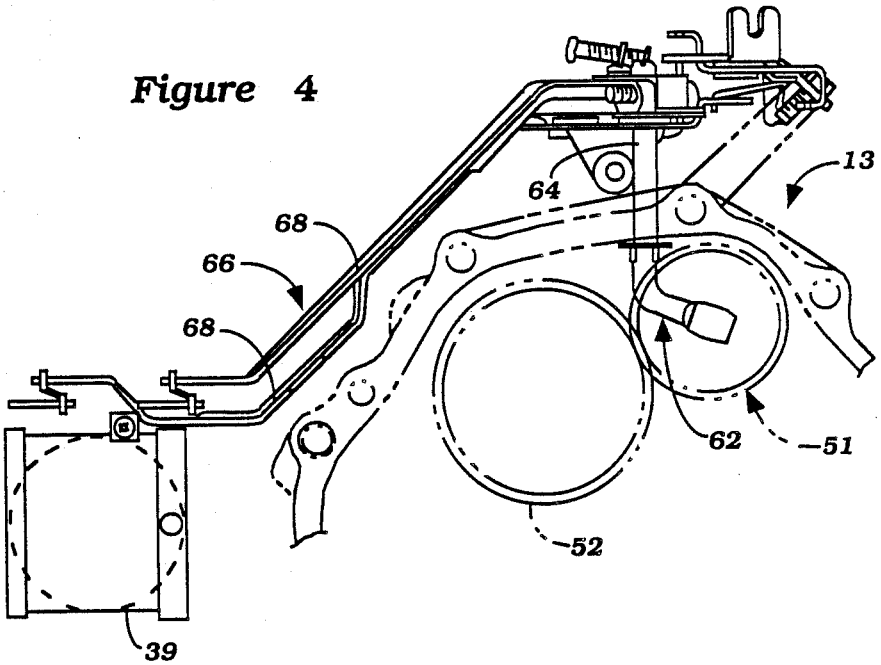
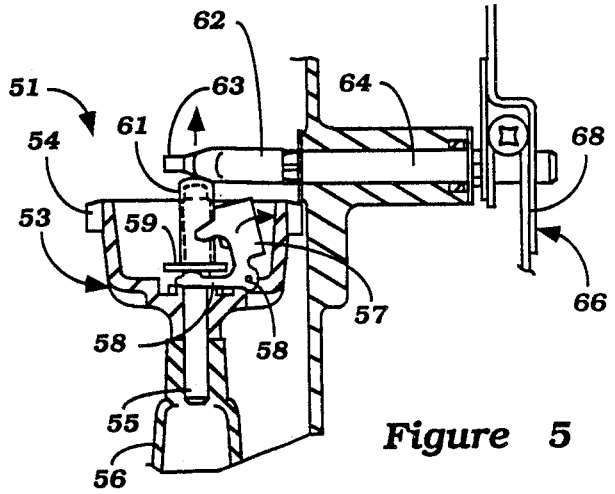
Figure 5

GOVERNOR FOR VERTICAL V-TYPE ENGINE

BACKGROUND OF THE INVENTION

This invention relates to a governor mechanism for a vertical V-type engine and more particularly to an improved arrangement for coupling the speed responsive element to the throttle valve in such an engne.

V-type engines or engines with the cylinder banks disposed to an angle to each other are utilized in a wide variety of applications. For example, such engines are frequently used to power small garden tractors. In such applications, the engine is positioned with the cylinder banks extending horizontally and the output shaft being rotatable about a vertical axis. In many applications like this, it is desirable to insure that the engine runs at a constant speed and a governor mechanism is provided for this purpose.

Normally, the governor mechanism includes a speed responsive element that is driven by the engine output shaft and which operates a throttle valve of the engine through a linkage system so as to maintain constant engine speed. The throttle valve is generally positioned at the opposite end of the cylinder banks from the area where the speed responsive element is positioned. As a result, the linkage system must extend outside of the engine and for a substantial distance. This gives rise to a rather bulky construction which has obvious disadvantages.

It is, therefore, a principal object of this invention to provide an improved compact governor mechanism for an engine having angularly disposed cylinder banks.

It is a further object of this invention to provide an improved and compact linkage system for an engine having angularly disposed cylinder banks.

SUMMARY OF THE INVENTION

This invention is adapted to be embodied in a governor mechanism for an internal combustion engine having a pair of cylinder banks that are disposed at an angle to each other and which are staggered along the length of the output shaft of the engine. A speed responsive element is driven by the output shaft contiguous to an adjacent end of the cylinder banks. A throttle valve is positioned adjacent the other ends of the cylinder banks for controlling the speed of the engine and a linkage system interconnects the speed responsive means to the throttle valve for maintaining the desired engine speed. In accordance with the invention, the linkage means includes at least one member that extends along one side of one of the cylinder banks, which cylinder bank is positioned further from a plane defined by the corresponding side of the other cylinder bank so that the member lies within the stagger of the cylinder banks so as to not unduly increase the size of the engine and associated components.

BRIEF DESCRIPTION OF THE DRAWINGS

FIG. 4 is a further enlarged view, looking generally in the same direction as FIG. 2, and showing the linkage system interconnecting the speed responsive element to the carburetor.

FIG. 5 is a cross-sectional view showing the interrelationship of the speed responsive element to the linkage system.

DETAILED DESCRIPTION OF THE PREFERRED EMBODIMENT

Figure 1:
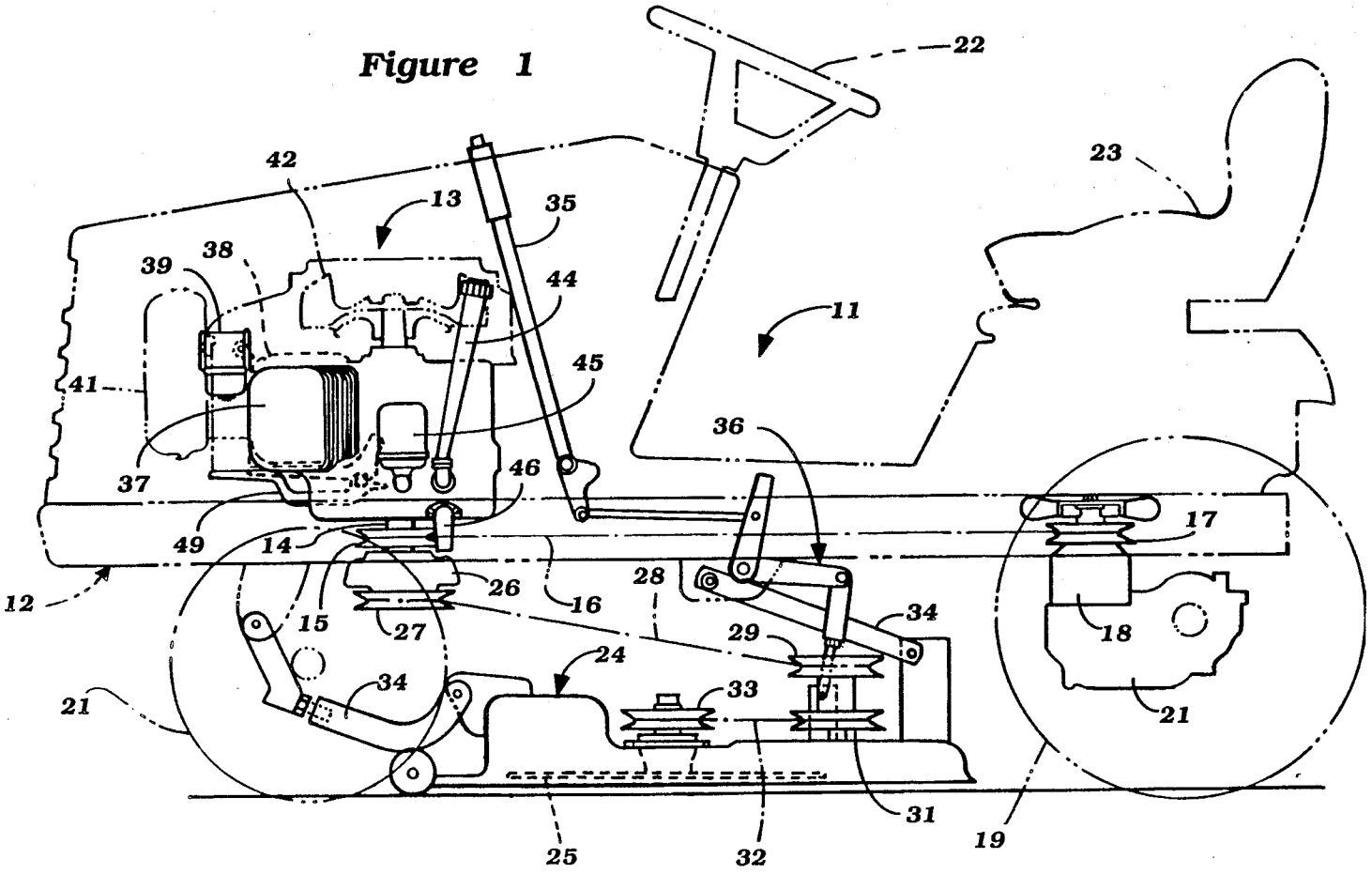
FIG. 1 is a side elevational view of a garden tractor and driven lawn mower accessory powered by an internal combustion engine constructed in accordance with an embodiment of the invention.

Referring first to FIG. 1, a small garden tractor or riding lawn mower powered by an internal combustion engine constructed in accordance with an embodiment of the invention is identified generally by the reference numeral 11. Since the invention relates primarily to the governor mechanism for the powering engine of the garden tractor Il, certain components of the garden tractor 11 have been shown in phantom so as to more clearly reveal the construction and operation of the invention.

The tractor 11 includes a frame assembly 12 that mounts an internal combustion engine 13 which, in the illustrated embodiment, is comprised of a V2, air-cooled, four-cycle engine. It is to be understood, however, that the invention has utility with engines having other numbers of cylinders but it has particular utility in conjunction with V type of engines have staggered cylinder banks, for a reason which will become apparent.

The engine 13 is disposed in the frame 12 with its output or crankshaft 14 rotating about a vertically extending axis and driving a first pulley 15 that is positioned beneath the engine 13. The pulley 15 drives a drive belt 16 which, in turn, drives a driven pulley 17 affixed to the input shaft of a hydrostatic transmission 18. The hydrostatic transmission 18 drives a pair of rear wheels 19 by means of a final drive assembly 21.

A pair of dirigible front wheels 21 are supported at the front of the frame assembly 12 in a known manner and are steered by means of a steering wheel 22 that is positioned forwardly of a rider's seat 23 carried to the rear of the frame 12.

The tractor 12 is shown associated with a lawn mower type of accessory, indicated generally by the reference numeral 24, and which is comprised of a cutting blade 25. The cutting blade 25 is driven from the engine output shaft 14 selectively through an electrically operated clutch 26 which couples a second driving pulley 27 to the engine output shaft 14. The driving pulley 27 drives a drive belt 28 that drives a first pulley 29 of the mower attachment 24. A second pulley 31 rotates with the driven pulley 29 and drives a drive belt 32 and pulley 33 that is affixed to the cutter shaft 25.

The mower 24 is supported for vertical movement relative to the frame 12 by means of a pair of parallel linkage systems 34. The height of the mower and the linkage systems 34 is controlled by a control lever 35 that is connected by a linkage system 36 to the mower housing in a suitable manner.

The aforedescribed construction is that of a typical environment in which the invention can be utilized. It is to be understood, however, that the invention can be utilized in conjunction with many other applications for internal combustion engines having angularly disposed cylinder banks.

Figure 2:
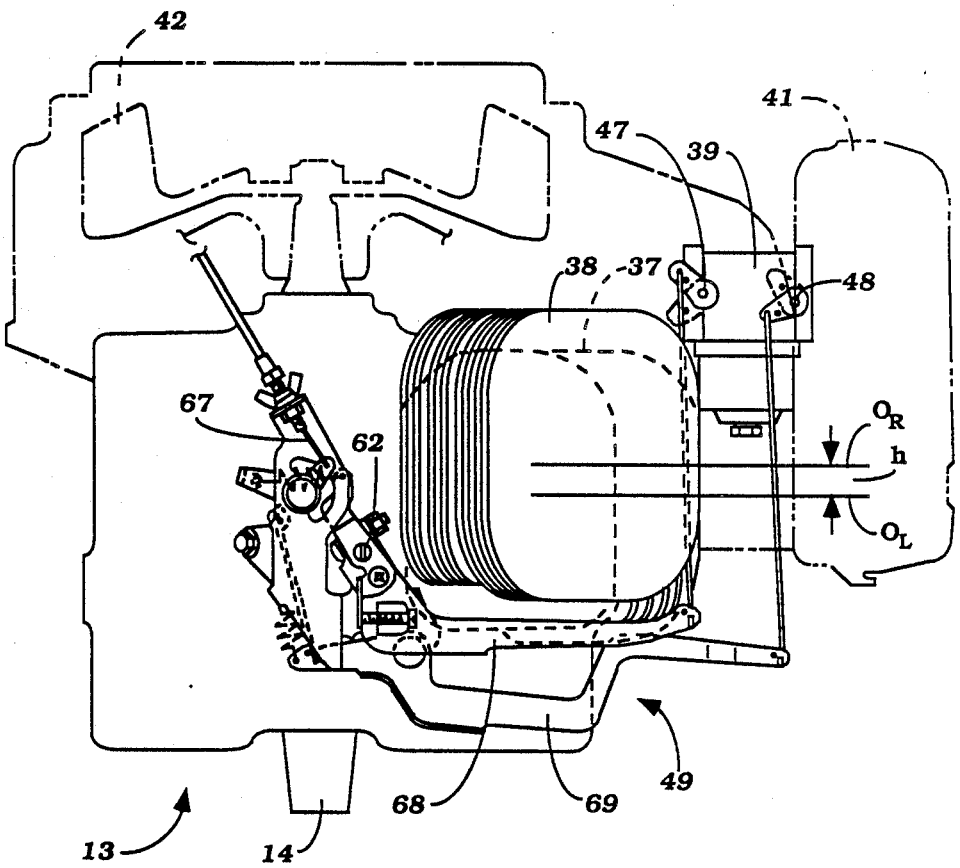
FIG. 2 is an enlarged, side elevational view showing the engine and governor mechanism taken from the side opposite to FIG. 1.

Referring now additionally to the remaining figures, the engine 13 has a pair of cylinder banks 37 and 38 which, in the illustrated embodiment, each contain a respective cylinder bore. The cylinder banks 37 and 38 are, in the illustrated embodiment, disposed at a right angle to each other. In addition, the cylinder banks 37 and 38 are staggered along the length of the crankshaft 14 so that the connecting rods (not shown) associated with the cylinders of the respective banks 37 and 38 may be connected to a common throw of the crankshaft 14 in a known manner with the connecting rods lying in a side-by-side fashion. The offset of the cylinder banks is indicated in FIG. 2 by the dimension h which shows the distance between the centerline of the left hand or lower cylinder bank 37 at $O_L$ and the centerline of the bore of the right hand or upper cylinder bank 38 at $O_R$.

The engine is provided with a carburetor 39 that is disposed in the area between the cylinder banks 37 and 38 and spaced from the ends of the cylinders remote from the crankshaft 14. The carburetor 39 supplies a fuel/air charge to the cylinders within the banks 37 and 38 through an appropriate manifold. An air cleaner or air inlet device 41 is attached to the inlet end of the carburetor 39 and supplies filtered and silenced air to the carburetor 39.

As has been previously noted, the engine 13 is of the air cooled type and to this end a cooling fan 42 is driven from the upper end of the crankshaft 14 and circulates cooling air around the engine. In addition, the engine is provided with an electrical starter 43 and a lubricating system that includes a lubricant filler pipe 44, a lubricant filter 45 and a lubricant drain 46. The basic construction of the engine, except for the stagger of the cylinder banks, forms no part of the invention and, for that reason, the components which may be considered to be conventional have not been illustrated and description of them is not believed to be necessary.

The carburetor 39 is provided with a throttle valve which does not appear in the drawings but which is of the butterfly type and is affixed to a throttle valve shaft 47. In addition, there is provided a choke valve for starting enrichment and this choke valve also does not appear in the drawings but is affixed for rotation with a choke valve shaft 48.

The carburetor throttle valve shaft 47 and choke valve shaft 48 are operated by means of a linkage system 49 from a governor mechanism including a speed responsive unit, indicated generally by the reference numeral 51 and driven from the crankshaft 14 through a gear train including a camshaft drive gear 52, which is driven directly from the engine crankshaft.

Figure 3:
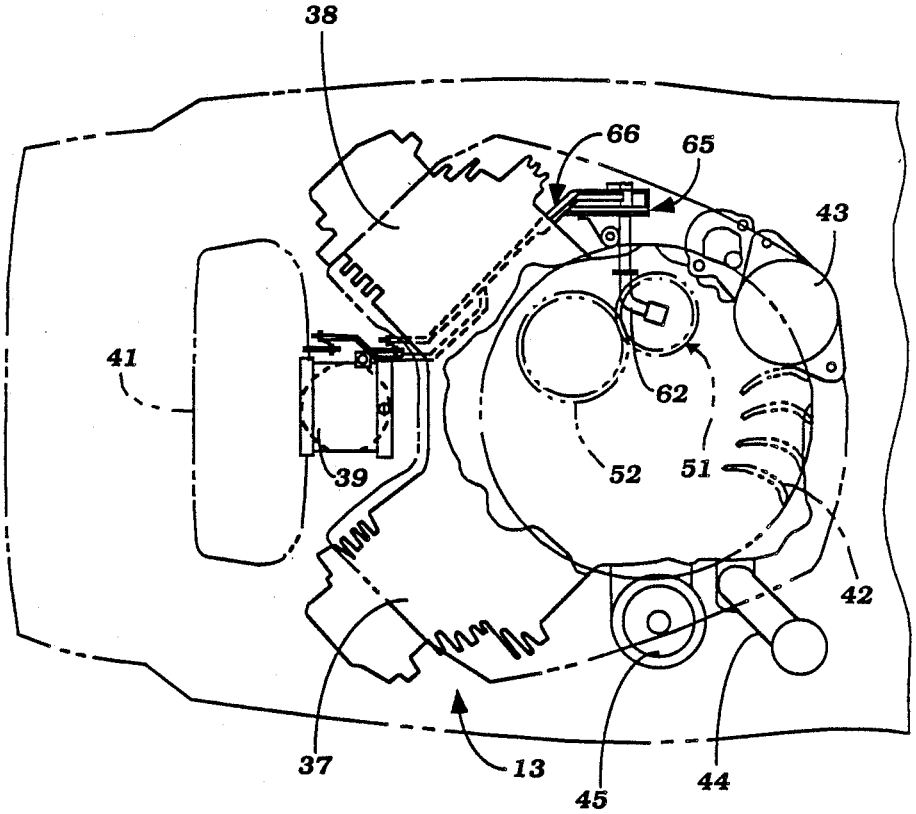
FIG. 3 is a top plan view of the engine and governor mechanism.

The construction of the speed responsive mechanism 51 may be best understood by reference to FIGS. 3 and 5 wherein there is provided a cup-like member 53 that has an integral gear 54 that is in mesh with the camshaft drive gear 52. The cup-like member 53 has affixed to it a shaft 55 that is journaled in a boss 56 of the engine crankcase. One or more inertial elements 57 are pivotally supported on the cup-shape member 53 by pivot shafts 58 that are offset from the axis of the shaft 55 and which extend perpendicularly to it. The inertial member 57 has a cam arm 58 that engages a flange 59 on a sleeve 61 which is slidably supported on the upper end of the shaft 55. As the speed of the engine increases, the flange 59 and sleeve 61 will move upwardly under the action of the inertial member 57.

A crank-like member 62 has an end portion 63 that is engaged with the sleeve 61 and a bearing portion 64 that is journaled within a housing of the engine. The opposite end of the crank member 62 operates on a governor mechanism, indicated generally by the reference numeral 65 which, in turn, controls the throttle valve shaft 47 and the choke shaft 48 through a linkage assembly, indicated generally by the reference numeral 66.

As may be seen in FIG. 2, an operator controlled Boden wire 67 is associated with the governor mechanism for controlling and varying the speed at which the governor mechanism will set for the engine 13 in a known manner. The linkage system 49 includes a throttle valve link 68 which extends adjacent the lower side of the cylinder bank 38 and which is generally positioned within the stagger between this cylinder bank and a plane defined by the lower side of the cylinder bank 37. As a result, this link does not protrude beyond the periphery of the general envelope defined by the engine 13 and thus a very compact construction results.

A further choke valve link 69 is connected to the choke valve shaft 48 and is operative so as to close the choke valve 48 when the engine is not running for starting enrichment but to immediately open the choke valve associated with the shaft 48 once the engine starts running. The other aspects of the governor control for the engine are believed to be well known to those skilled in the art and, for that reason, detailed description of them is not believed to be necessary.

It should be readily apparent that the described linkage system and its relationship to the stagger of the engine provides a very compact arrangement for transmitting control from the speed responsive element of the engine to a remotely positioned throttle valve. Although an embodiment of the invention has been illustrated and described, various changes and modifications may be made without departing from the spirit and scope of the invention, as defined by the appended claims.

We claim:

1. A governor mechanism for an internal combustion engine having a pair of cylinder banks disposed at an angle relative to each other, said cylinder banks being staggered along the length of the output shaft of the engine, a speed responsive element driven by said output shaft contiguous to the adjacent end of said cylinder banks, a throttle valve positioned adjacent the other ends of said cylinder banks for controlling the speed of said engine, and linkage means interconnecting said speed responsive means to said throttle valve for maintaining a desired engine speed, said linkage means including at least one member extending along one side of the cylinder which side is positioned further from a plane defined by the corresponding side of the other cylinder bank so that the member is disposed within the stagger area of the cylinder banks.

2. A governor mechanism as set forth in claim 1 wherein the cylinder banks are disposed at a V to each other.

3. A governor mechanism as set forth in claim 1 wherein the throttle valve is associated with a carburetor disposed in an area between the cylinder banks.

4. A governor mechanism as set forth in claim 3 wherein the cylinder banks are disposed at a V to each other and wherein the carburetor is positioned in the valley of the V.

* * * * *